US011131146B2

(12) United States Patent
Bangert et al.

(10) Patent No.: US 11,131,146 B2
(45) Date of Patent: Sep. 28, 2021

(54) PREVENTION OF BACKFLOW DURING DRILLING AND COMPLETION OPERATIONS

(71) Applicants: Daniel Stephen Bangert, Brousard, LA (US); James Smith, Handewitt (DE)

(72) Inventors: Daniel Stephen Bangert, Brousard, LA (US); James Smith, Handewitt (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 95 days.

(21) Appl. No.: 16/253,841

(22) Filed: Jan. 22, 2019

(65) Prior Publication Data

US 2020/0232283 A1 Jul. 23, 2020

(51) Int. Cl.

| | |
|---|---|
| ***E21B 7/20*** | (2006.01) |
| ***E21B 17/16*** | (2006.01) |
| ***E21B 33/14*** | (2006.01) |
| ***E21B 33/12*** | (2006.01) |

(52) U.S. Cl.

CPC ..... *E21B 7/20* (2013.01); *E21B 17/16* (2013.01); *E21B 33/14* (2013.01); *E21B 33/12* (2013.01)

(58) Field of Classification Search

CPC . E21B 7/20; E21B 17/16; E21B 33/14; E21B 33/12

See application file for complete search history.

(56) References Cited

U.S. PATENT DOCUMENTS 4,671,358 A * 6/1987 Lindsey, Jr. ..... E21B 34/14 166/154
8,281,878 B2 10/2012 Erikson
9,249,646 B2 * 2/2016 Hannegan ..... E21B 33/165
10,087,725 B2 * 10/2018 Giroux ..... E21B 43/045
2007/0261850 A1 * 11/2007 Giroux ..... E21B 7/20 166/291
2011/0056703 A1 * 3/2011 Eriksen ..... E21B 7/20 166/381

(Continued)

FOREIGN PATENT DOCUMENTS

WO 2012083047 A1 6/2012

OTHER PUBLICATIONS

International Search Report for International Application No. PCT/US2020/014118; International Filing Date Jan. 17, 2020, dated May 21, 2020; 4 pages.

(Continued)

*Primary Examiner* — Crystal J Miller

(74) *Attorney, Agent, or Firm* — Cantor Colburn LLP

(57) ABSTRACT

A system includes a drill bit, and a tubular connected thereto. The tubular is configured to be rotated to rotate the drill bit and drill a length of a borehole and cemented in place. The tubular and the drill bit form a conduit to permit cement to be pumped through the tubular and the drill bit and into an annulus. The system also includes a collar disposed between the tubular and the drill bit. The collar includes a receptacle made from a drillable material, which has a profile that corresponds to a shape of a component deployed through the length of the tubular, and is configured to form a substantially fluid tight seal between the component and the drillable material when the component is seated in the receptacle. The collar and the component prevent backflow of the cement.

20 Claims, 8 Drawing Sheets

(56) References Cited

U.S. PATENT DOCUMENTS

| | | | | |
|---|---|---|---|---|
| 2011/0061876 | A1 | 3/2011 | Johnson et al. | |
| 2013/0118752 | A1* | 5/2013 | Hannegan | E21B 33/143 166/336 |
| 2014/0305662 | A1* | 10/2014 | Giroux | E21B 33/146 166/386 |
| 2015/0167424 | A1* | 6/2015 | Richards | E21B 33/13 166/386 |
| 2019/0032456 | A1* | 1/2019 | Giroux | E21B 33/14 |

OTHER PUBLICATIONS

Written Opinion for International Application No. PCT/US2020/014118; International Filing Date Jan. 17, 2020, dated May 21, 2020; 4 pages.

* cited by examiner

PREVENTION OF BACKFLOW DURING DRILLING AND COMPLETION OPERATIONS

BACKGROUND

In the resource recovery industry, various operations are performed to evaluate resource bearing formations and recover resources such as hydrocarbons. Such operations include drilling, directional drilling, completion and production operations. Drilling and completion processes typically entail deploying a drill string with a drill bit, drilling a section of a borehole, removing the drill string, and subsequently deploying a section of casing and cementing the casing in the borehole.

SUMMARY

An embodiment of a system for performing a drilling and completion operation includes a drill bit, and a tubular connected to the drill bit. The tubular is configured to be rotated to rotate the drill bit and drill a length of a borehole, and left in the borehole and cemented in place after the length of the borehole is drilled. The tubular and the drill bit form a conduit to permit cement to be pumped through the tubular and the drill bit and into an annulus between the tubular and a borehole wall. The system also includes a collar disposed between the tubular and the drill bit. The collar includes a receptacle made from a drillable material. The receptacle has a profile that corresponds to a shape of a component deployed through the length of the tubular, and is configured to form a substantially fluid tight seal between the component and the drillable material when the component is seated in the receptacle. The collar and the component prevent backflow of the cement.

A method of drilling and completing a length of a borehole includes deploying a drilling assembly at an earth formation, the drilling assembly including a drill bit, a tubular connected to the drill bit, and a collar disposed between the tubular and the drill bit. The collar includes a receptacle made from a drillable material and having a profile that corresponds to a shape of a component to be deployed through the length of the tubular. The method also includes drilling the length of the borehole by rotating the tubular and causing the drill bit to rotate, and deploying the component through the tubular and seating the component in the receptacle, where seating results in a substantially fluid tight seal between the component and the drillable material. The method further includes pumping a cement through the component, the collar and the drill bit and into an annulus between the tubular and a borehole wall, and preventing backflow of the cement, and allowing the cement to set and form a seal between the tubular and the borehole wall.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
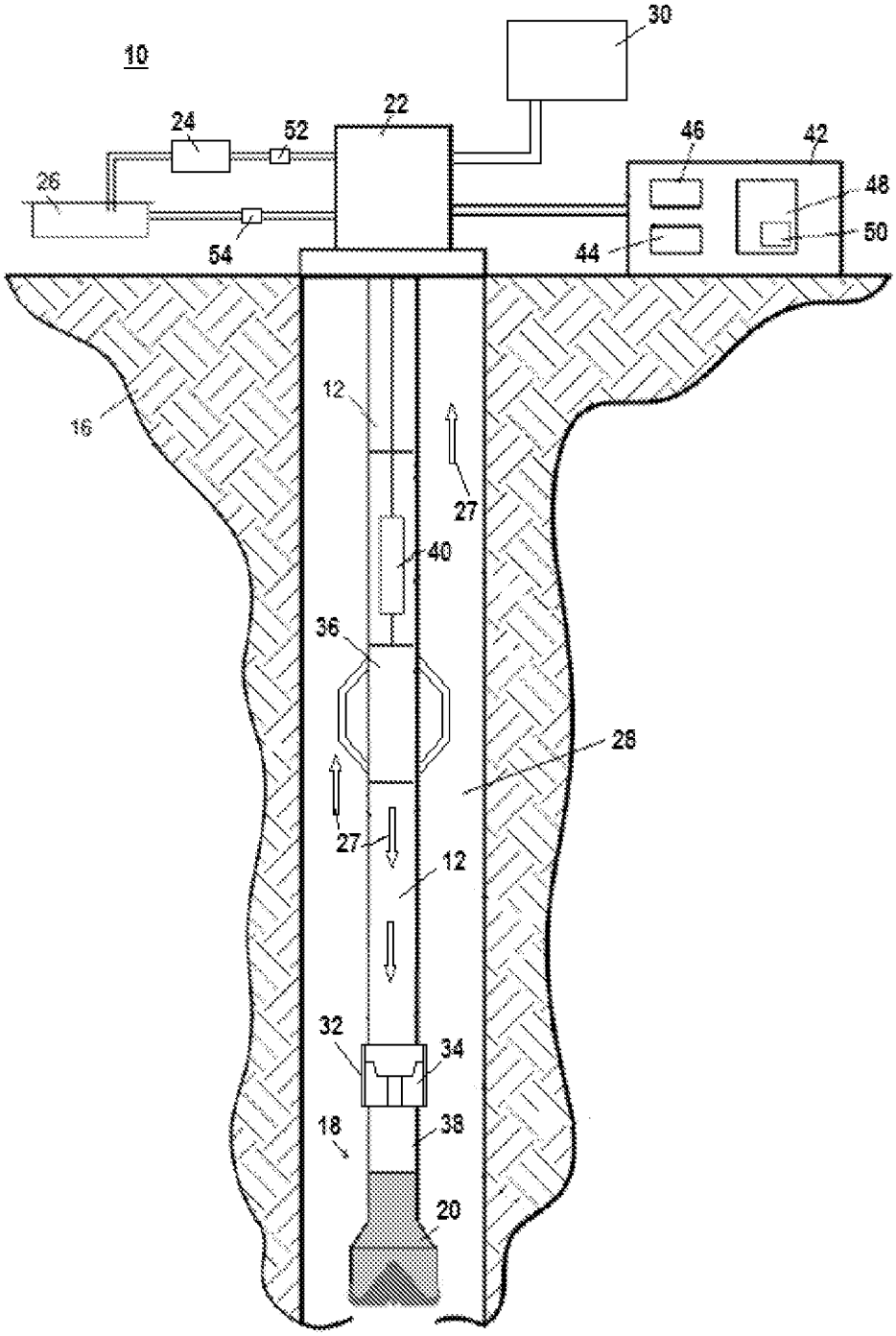
FIG. 1 depicts an embodiment of a drilling and completion system.

FIG. 1 illustrates an example of a system 10 that can be used to perform one or more energy industry operations, such as a drilling and completion operation. The system 10 includes a borehole string 12 disposed in a borehole 14 that penetrates at least one earth formation 16. Although the borehole 14 is shown in FIG. 1 to be of constant diameter, those of skill in the art will appreciate boreholes are not so limited. For example, the borehole 14 may be of varying diameter and/or direction (e g, azimuth and inclination). The system 10 and/or the borehole string 12 includes various downhole components or assemblies, such as a drilling assembly and various measurement tools and communication assemblies, one or more of which may be configured as a bottomhole assembly (BHA) 18.

In one embodiment, the system 10 includes capabilities to perform a casing while drilling (CwD) operation. Casing while drilling (CwD) is a technique that is used to eliminate traditional casing runs and isolate formations while drilling. Instead of using a separate drill string, CwD techniques run casing into a borehole with a drill bit and drill the borehole using a casing string to rotate the drill bit.

In this embodiment, the borehole string 12 is a casing string 12 that includes one or more sections of casing. As described herein, "casing" refers to a tubular that is deployed and left downhole to seal off a section of formation from the borehole 14. Casing generally encompasses conventional casing and liners or any other tubular that may be left downhole and/or cemented in place.

The system 10, in one embodiment, includes a drilling and completion assembly that includes a drill bit 20 that is driven by rotating the casing string 12. The system 10 has surface equipment 22 that includes components for rotating the casing string 12 from the surface, such as a rotary table or surface drive. Although embodiments are discussed herein with respect to a drill bit driven from the surface, they are not so limited. For example, the drill bit 20 can be rotated by a downhole device such as a mud motor.

In one embodiment, the drill bit 20 is made of a drillable or millable material, i.e., a material that can be drilled through by another drill bit after drilling with the drill bit 20 ceases. In this embodiment, the drill bit 20 is referred to as a drillable bit 20. In other embodiments, the drill bit 20 can be drillable or millable (for example, based on the size of the casing string 12). An example of a drillable material is cement, a drillable alloy such as a copper bronze alloy, or a plastic material.

The system 10 also includes components to facilitate circulating fluid such as drilling mud and/or a cement slurry through the casing string 12. A pumping device 24 is located at the surface to circulate fluid from a mud pit or other fluid source 26 into the borehole 14. During drilling, borehole fluid 27 such as drilling fluid (e.g., drilling mud) is pumped through a conduit such an interior bore of the casing string 12, then exits the casing string 12 and travels upward through an annulus 28 of the borehole 14 (between the borehole string 12 and the borehole wall) and returns to the surface.

As noted above, the system 10 may be configured to perform a drilling and completion operation. For such an operation, the system 10, in one embodiment, includes a cement mixer or mixing tank 30 that can be connected to the surface equipment 22. The mixing tank 30 provides a cement slurry that is pumped through the casing string 12 and into the annulus 28. The cement slurry is allowed to set and form a barrier between the casing string 12 and the formation 16 to seal off a zone of the formation 16 from the borehole 14.

The system 10 includes additional components for facilitating the drilling and completion operation and injection of cement into the annulus 28. In one embodiment, the system 10 includes a collar 32 disposed between the casing string 12 and the drill bit 20. The collar 32 connects the casing string 12 to the drill bit 20. The collar 32 may be a component separate from the drill bit 20 and configured to be connected to the drill bit 20 (e.g., via threaded connection), or may be integral with the drill bit 20 and form part of the drill bit 20. The collar 32 includes a drillable material such as cement, a metal alloy or a plastic (polymer) material, which allows the system 10 to drill through the drilling and completion assembly after cement is injected into the annulus 28 and sets. The drillable material forms a cavity or receptacle 34 having a profile or shape that corresponds to the shape of a downhole component that is deployed with cement. For example, the receptacle 34 forms a profile that corresponds to or matches the shape of part of a wiper plug, stab-in sub, dart or other component. When the component is seated in the receptacle 34, a fluid tight seal is formed between the component and the collar 32. "Fluid tight" refers to a characteristic that prevents ingress of cement, drilling mud or other fluid that is injected into the casing string 12.

Various other components may be included. Such components may include one or more centralizers 36 and/or a connection conduit 38 that attaches the collar 32 to the drill bit 20. Various sensors may be disposed downhole to monitor downhole conditions, such as temperature, pressure, fluid flow rate and fluid characteristics.

In one embodiment, one or more downhole components and/or one or more surface components may be in communication with and/or controlled by a processor such as a downhole processor 40 and/or a surface processing unit 42. In one embodiment, the surface processing unit 42 is configured as a surface control unit which controls various parameters such as rotary speed, weight-on-bit, fluid flow parameters (e.g., pressure and flow rate) and others.

The processing unit 42 (and/or the downhole processor 40) may be configured to perform functions such as controlling drilling and steering, controlling the pumping of borehole fluid and/or cement injection, transmitting and receiving data, processing measurement data, and/or monitoring operations of the system 10. The processing unit 42, in one embodiment, includes an input/output device 44, a processor 46, and a data storage device 48 (e.g., memory, computer-readable media, etc.) for storing data, models and/or computer programs or software 50 that cause the processor to perform aspects of methods and processes described herein.

Surface and/or downhole sensors or measurement devices may be included in the system 10 for measuring and monitoring aspects of an operation, fluid properties, component characteristics and others. In one embodiment, the surface processing unit 42 and/or the downhole processor 40 includes or is connected to various sensors for measuring fluid flow characteristics. For example, the system 10 includes fluid pressure and/or flow rate sensors 52 and 54 for measuring fluid flow into and out of the borehole 14, respectively. Fluid flow characteristics may also be measured downhole, e.g., via fluid flow rate and/or pressure sensors in the casing string 12.

In traditional completion operations, a casing is deployed with a float shoe and a float collar, both of which include a backflow check valve to prevent backflow of cement from a borehole annulus into a casing. It has been found that using a traditional float collar can be insufficient for DwC applications, in that such float collars may not be able to survive the extended periods of high rate circulation that are typical of DwC operations. Traditional float collars also reduce the potential flow rates. Embodiments described herein address such insufficiencies by providing a drillable collar that receives a plug or other component to prevent backflow, without requiring the use of check valves or other components that could be compromised by extended periods of high rate circulation. In one embodiment, the receptacle is formed such that the collar has no moving parts.

Figure 2:
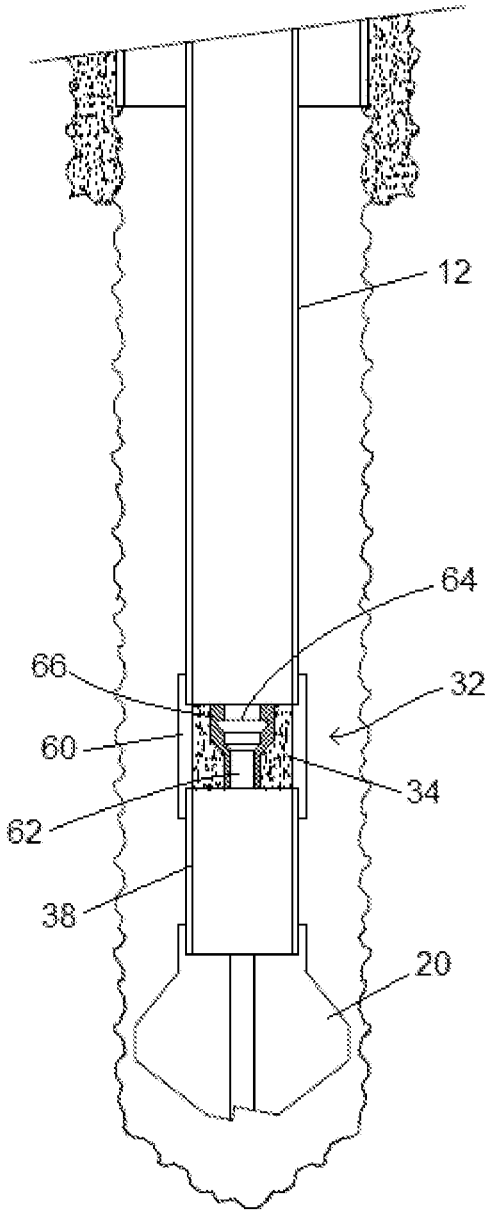
FIG. 2 depicts aspects of an embodiment of a drilling and completion assembly that includes a drillable collar configured to prevent backflow of cement during a drilling and completion operation.

Referring to FIG. 2, an embodiment of a DwC drilling and completion assembly includes the collar 32 or other connection device that receives a plug or other component that is deployed to facilitate the injection of cement to complete a length of the borehole 14. The collar 32 includes the drillable receptacle 34, which is configured to receive the deployed component and form a substantially fluid tight seal between the component and the receptacle 34, and form a backflow prevention device that prevents cement slurry from flowing backward from the annulus 28 into the casing string 12. The collar may be attached or connected by any suitable mechanism to the drill bit 20, such as by the connection conduit 38. The connection conduit 38 may be configured as a stabilizer if desired.

The collar 32 includes a sleeve 60 or tubular that houses the drillable receptacle 34 and can survive extended, high-rate circulation typical of DwC operations. The drillable receptacle 34 may be made of cement (e.g., the same cement that is injected into the annulus 28), a metal alloy or any other suitable solid material that can be drilled through. The drillable receptacle 34 forms a fluid conduit 62, and an internal profile 64 that is in fluid communication with the conduit 62 and that forms a shape such that a plug or other component seated in the collar 32 forms a fluid tight seal between the receptacle 34 and the component.

In one embodiment, the drillable receptacle 34 is made from a single material or unitary solid component. For example, the entirety of the receptacle 34 can be made from cement. In another embodiment, the drillable receptacle 34 is made from multiple materials. For example, as shown in FIG. 2, the receptacle 34 may be lined with a deformable material 66 such as an elastomer, or a material that is softer or less rigid than the cement or other material making up the remainder of the receptacle 34.

Figure 3:
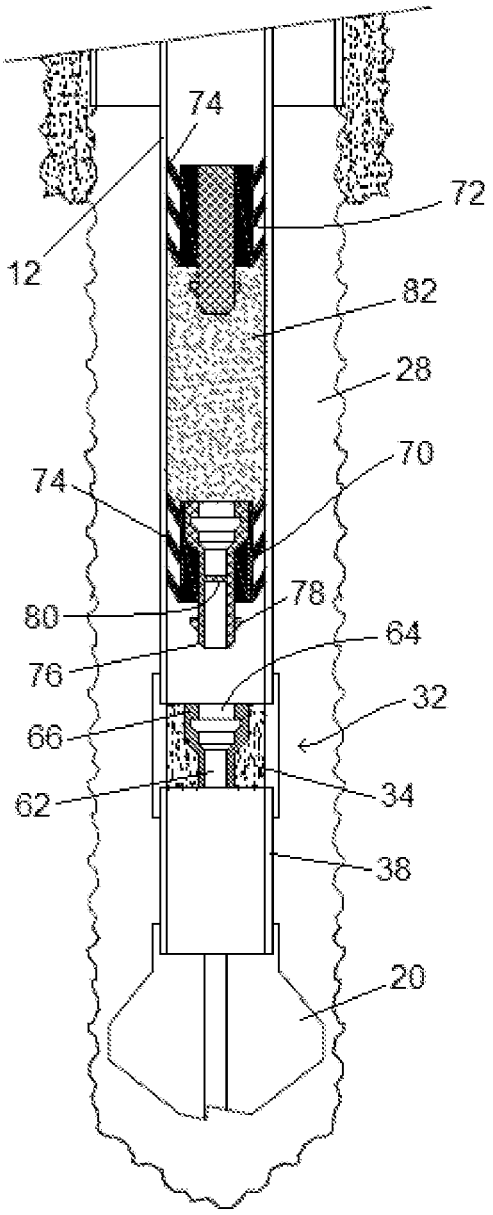
FIG. 3 depicts the drilling and completion assembly of FIG. 2 when cement is pumped downhole during the drilling and completion operation.
Figure 4:
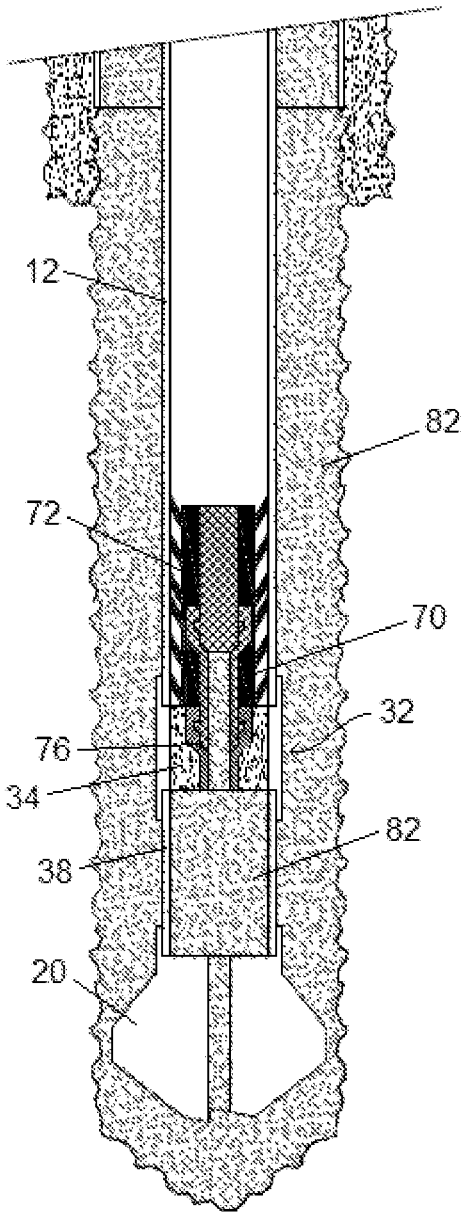
FIG. 4 depicts the drilling and completion assembly of FIGS. 2 and 3, after the cement is circulated into an annulus of a borehole.

FIGS. 3 and 4 illustrate an example of a drilling and completion process and an example of components that are deployed downhole to facilitate injection of cement and/or prevent backflow. In this example, the deployed component includes a pump down plug 70 that is deployed into the casing 12 and seated in the receptacle 34. An upper plug 72 may also be deployed as discussed further below. The plugs 70 and 72 may be configured as wiper plugs, having fins 74 that wipe the surface of the casing string 12 as the plugs travel through the casing string 12.

In this example, the pump down plug 70 includes a nose section 76 that is shaped to engage with and form a fluid tight seal with the receptacle 34. The nose may have a latching feature such as a ridge or protrusion 78 that engages corresponding features of the profile 64, to prevent upward movement due to pressure from below. The pump down plug 70 also forms a conduit that includes a rupture disc 80. The rupture disc 80 blocks fluid flow through the pump down plug 70 until a selected fluid pressure is reached, at which point the rupture disc 80 ruptures and permits fluid to flow therethrough. The pump down plug 70 may also have an anti-rotation lock or other feature to prevent rotation and facilitate a quick drill-out of the pump down plug 70. The upper plug may also include a latching feature and/or anti-rotation feature, similar to those of the pump down plug 70.

FIGS. 2-4 show various stages of a drilling and completion operation that utilizes DwC. FIG. 2 depicts a drilling phase in which a length of the borehole 14 is drilled. FIG. 3 depicts a phase in which cement 82 is injected into the casing string 12 as a cement slurry, and the plugs 70 and 72 are deployed in the casing string 12. FIG. 4 depicts a phase where the cement 82 has been deployed through the drilling and completion assembly and into the annulus 28 of the borehole 14.

Figure 5:
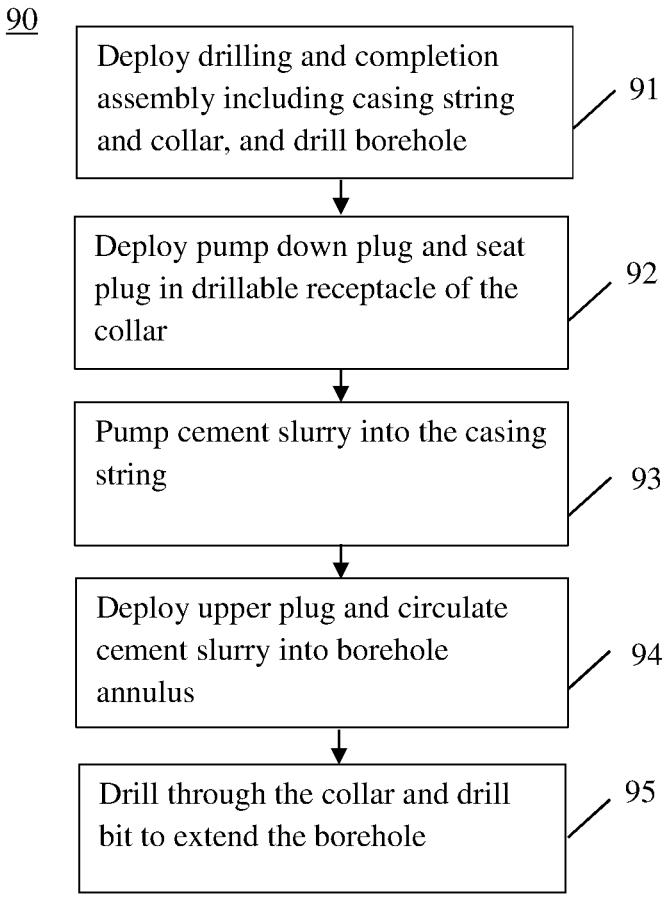
FIG. 5 is a flow chart depicting aspects of a method of drilling and completing a section or length of a borehole.

FIG. 5 illustrates a method 90 of drilling and completing a length of a borehole. In one embodiment, the method 90 involves casing while drilling (CwD), but is not so limited, as the method may be used in any context where it is desired to prevent or reduce the backflow of fluid (e.g., cement or drilling mud).

The method 90 may be used in conjunction with the system 10, although the method 90 may be utilized in conjunction with any suitable type of device for which fluid control and backflow prevention is desired. The method 90 includes one or more stages 91-95. In one embodiment, the method 90 includes the execution of all of stages 91-95 in the order described. However, certain stages may be omitted, additional stages may be added, and/or the order of the stages may be changed.

The method 90 is discussed with reference to the embodiment of the drilling and completion assembly shown in FIGS. 2-4. It is noted that the assembly of FIGS. 2-4 is discussed for illustrative purposes and is not intended to be limiting, as the method 90 can be used in conjunction with any suitable assembly having a drillable collar as described herein.

In the first stage 91, the drilling and completion assembly is deployed and the borehole 14 is drilled to a desired location or depth (e.g., total depth or TD). During drilling, borehole fluid 27 is pumped through the casing string 12, the collar 34, the connection conduit 38 and the drill bit 20. The drill bit 20 may have a fluid conduit to permit circulation of the fluid 27 through the drill bit 20. The drill bit 20 is made from a drillable material. After drilling is completed, the fluid 27 may be circulated to clean up the borehole 12.

In the second stage 92, shown in FIG. 3, the pump down plug 70 (also referred to as a latch down plug) is pumped into the casing string 12 to provide separation between the fluid 27 and the cement 82. The pump down plug 70 lands in and is seated in the receptacle 34 but does not inhibit the flow of the cement 82. The pump down plug 70 includes a latching feature such as the nose 76, which has a shape that will allow the pump down plug 70 to seal against the receptacle 34, i.e., form a fluid tight seal. The latching feature prevents upward movement of the pump down plug due to pressure from below. For example, the nose 76 has a cylindrical shape and a ridge 78, and the receptacle 34 has a profile that corresponds to the shape of the nose 76 and the ridge 78. In one embodiment, as shown in FIGS. 2 and 3, the receptacle 34 may include a deformable material (e.g., an elastomer) 66 that allows the ridge 78 to engage the corresponding recess in the receptacle 34. In another embodiment, the receptacle 34 is completely formed from rigid material and the ridge 78 and/or the nose 76 are deformable.

In the third stage 93, the cement 82 is pumped as a slurry into the casing string 12 with the pump down plug 70. The amount of slurry is selected so that the cement 82 fills a selected length of the annulus 28. The slurry pushes the pump down plug 70 into the receptacle, and pressure is maintained or increased until the rupture disc 80 in the plug ruptures, permitting the slurry to flow through the pump down plug 70, the collar 32, the connection conduit 38 and the drill bit 20 into the annulus 28. Engagement between the pump down plug 70 and the collar 34 can be indicated by a pump pressure spike when the pump down plug 70 lands on the collar 32.

In the fourth stage 94, once the required volume of cement 82 has been pumped, more of the fluid 27 is pumped into the casing string 12 and the upper plug 72 is released. The upper plug 72 provides separation between the fluid 27 and the cement 82. Fluid pressure may be monitored, and a second pressure spike can be detected that indicates that the upper plug 72 has latched onto the pump down plug 70. The combination of the pump down plug 70 and the upper plug 72 creates a barrier to prevent return flow once they have latched into the collar 32. FIG. 4 shows the drilling and completion assembly with the plug 70 and the upper plug 72 latched onto the collar 32 and the cement 82 fully displaced into the annulus 28.

In the fifth stage, after allowing adequate time for the cement 82 to set, typically referred to "waiting on cement" or "WOC", further operations may be performed. For example, a drill bit and BHA having a diameter smaller than the internal diameter of the casing string 12 is deployed, and drills through the plugs 70 and 72, the collar 32, the connection conduit 38 and the drill bit 20. The borehole 12 can then be extended by drilling further from the drill bit 20. The subsequent drilling operation can be a CwD operation if desired. In some instances, after drilling and cementing is complete, a backflow valve may be deployed to contain the hydrostatic differential pressure, post cementing.

As previously noted, the embodiments described herein are not limited to any particular type of plug or component that is deployed and seated on the receptacle. Any suitable type of deployable component may be used. For example, the component may be a bridge plug, a stab-in sub or a frac plug.

For example, one or more plugs can be deployed and seated onto the collar 32 and the drillable receptacle by deploying a tubular through the casing string 12. Examples of such a tubular can be drill pipe, coiled tubing or smaller casing strings (liners).

Figure 6:
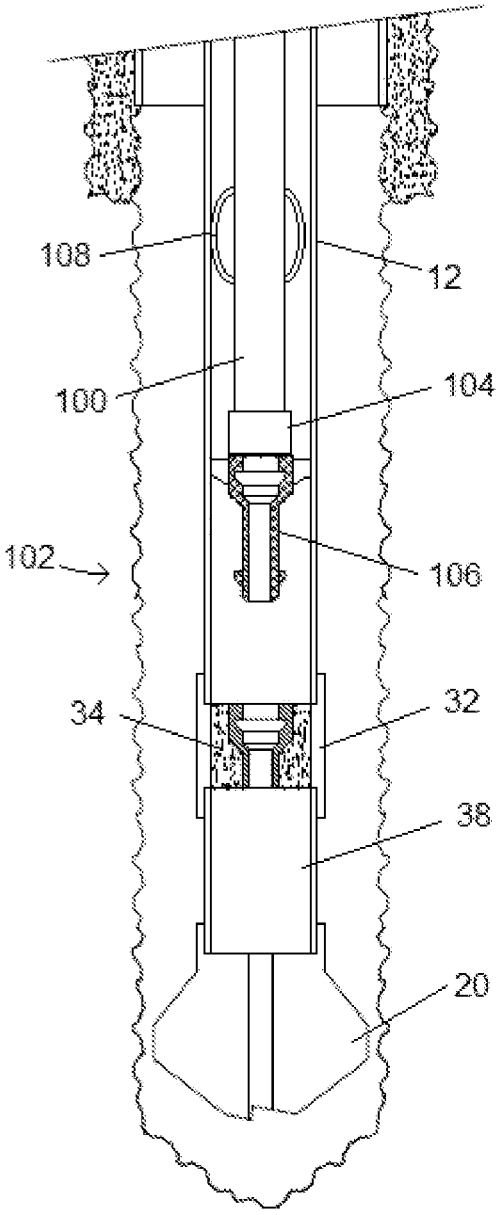
FIG. 6 depicts aspects of an embodiment of a drilling and completion assembly that includes a drillable collar and a stab-in assembly.
Figure 7:
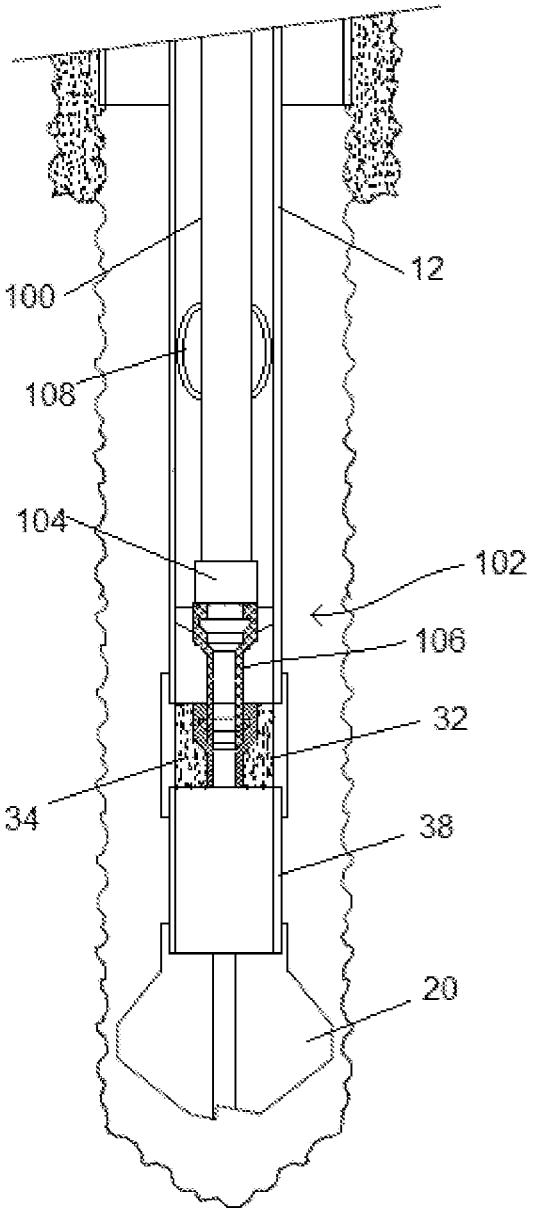
FIG. 7 depicts the drilling and completion assembly of FIG. 6 when the stab-in assembly is seated in the drillable collar.
Figure 8:
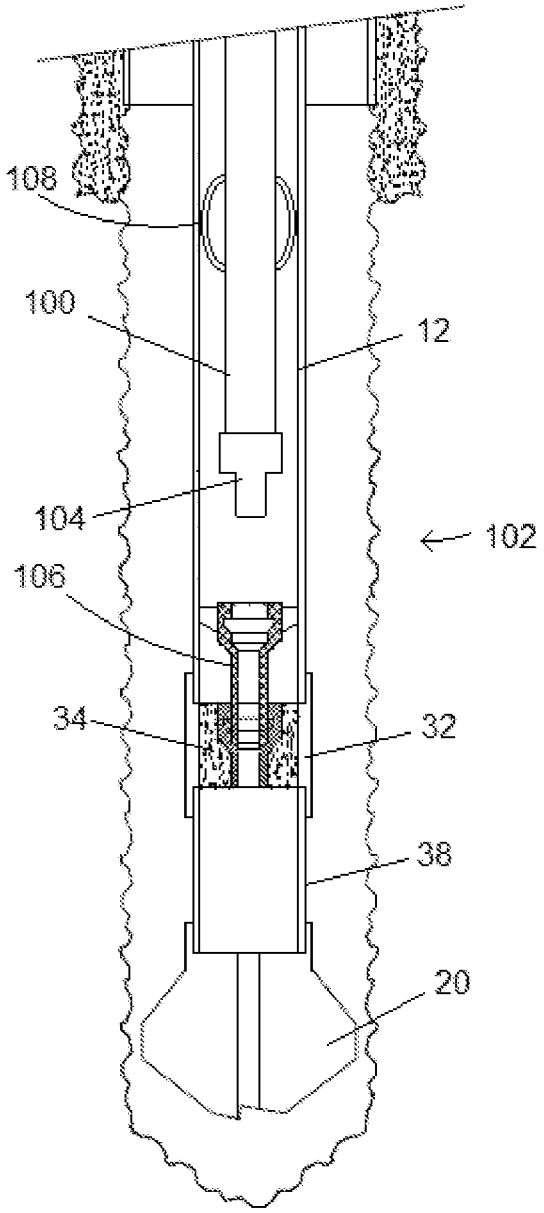
FIG. 8 depicts the drilling and completion assembly of FIGS. 6 and 7, after cement is circulated into an annulus of a borehole.

FIGS. 6-8 show an embodiment of the DwC drilling and completion assembly 10, in which at least one plug is deployed through the casing string 12 using a tubular. In this embodiment, a tubular 100 (also referred to as an inner string 100) having a smaller diameter than the casing string 12 is deployed through the casing string 12 to a selected location. The inner string 100 can be, e.g., drill pipe or casing (liner).

The inner string 100 may be deployed with the casing string 12 after the casing string 12 is drilled to a selected depth and prior to pumping cement. The inner string 100 may be deployed to a selected location such that the inner string 100 is suspended at a selected position along the casing string 12.

FIG. 6 shows the inner string 100 in a run-in position prior to seating on the collar 32. The inner string 100 includes a stab-in assembly 102 having a stinger component 104. The stinger component 104 is configured to retain a cementing plug 106. Other components may be included, such as a centralizer 108.

The cementing plug 106 may be designed specifically for stab-in configurations, and/or may be configured similar to the pump down plug 70. The stinger component 104 is configured to retain the cementing plug 106 and release the cementing plug 106 once the cementing plug 106 is seated in the drillable receptacle. FIG. 7 shows the stinger component and the cementing plug 106 seated in the receptacle 34, and circulation of cement 82. It is noted that the specific shape, size or configuration of the drillable receptacle 34 and corresponding cementing plug 106 is not limited to the embodiments described herein.

After the stinger component 104 is seated, cement 82 is circulated through the inner string 100, the collar 32 and the annulus until the cement 82 is fully displaced. The cement 82 may be displaced by pumping drilling fluid (or any other suitable fluid) behind the cement. Optionally, a plug, dart or other deployable component may be used to facilitate circulation by deploying the component behind the cement 82. An example of a deployable component is the upper plug 72.

As shown in FIG. 8, once circulation of the cement 82 is complete, the stinger component 104 is released and the inner string 100 is retracted out of the borehole. The inner string 100 may be retracted once the cement 82 has set, or may be retracted at any time after circulation of cement 82 is complete if there is a mechanism to prevent backflow of the cement 82. For example, the cementing plug 106 can have a backflow valve integrated therein, or another plug (e.g., a solid plug such as a plug similar to the upper plug 72) can be deployed (e.g., pumped down) and latched onto the cementing plug 106 prior to retracting the stinger component 104. A drill bit having a sufficiently small diameter is then deployed and the borehole can be extended by drilling through the cementing plug 106, the collar 32 and the drill bit 20.

Stab-in cementing is useful, e.g., for larger diameter casing. Stab-in cementing has a number of advantages, such as requiring less cement to ensure cement circulation to the surface and improving displacement accuracy. Other advantages include reduced contamination of the cement and reduced pumping time (eliminating the need for cement retarders). Generally, the entire process can be simplified and performed in less time than other displacement methods.

Embodiments described herein present a number of advantages and technical effects. The systems and methods described herein allow increased reliability of CwD systems, by providing a collar that does not require a check valve or any moving parts to perform the function of containing hydrostatic head created by a column of cement in an annulus after being subjected to extended high rate circulation times associated with drilling with casing.

Conventional backflow valves present and number of challenges that are addressed by embodiments described herein. For example, backflow valves are not designed to withstand the high volumes of flow required for CwD applications, and may fail to function, being unable to create a seal capable of handling backflow pressures. In addition, some designs create a flow restriction that can limit the amount of fluid flow required to successfully drill particular sections, when high flow rates are required. Embodiments described herein address these challenges by providing a drillable receptacle that can withstand high volumes and avoid using traditional backflow valves during cementing.

Set forth below are some embodiments of the foregoing disclosure:

Embodiment 1

A system for performing a drilling and completion operation, comprising: a drill bit; a tubular connected to the drill bit and configured to be rotated to rotate the drill bit and drill a length of a borehole, the tubular configured to be left in the borehole and cemented in place after the length of the borehole is drilled, the tubular and the drill bit forming a conduit to permit cement to be pumped through the tubular and the drill bit and into an annulus between the tubular and a borehole wall; and a collar disposed between the tubular and the drill bit, the collar including a receptacle made from a drillable material, the receptacle having a profile that corresponds to a shape of a component deployed through the length of the tubular, the receptacle configured to form a substantially fluid tight seal between the component and the drillable material when the component is seated in the receptacle, wherein the collar and the component prevent backflow of the cement.

Embodiment 2

The system of any prior embodiment, wherein the drilling and completion operation is a casing while drilling (CwD) operation, and the tubular is a length of a casing.

Embodiment 3

The system of any prior embodiment, wherein the drill bit is made from a drillable material.

Embodiment 4

The system of any prior embodiment, wherein the component and the receptacle form a conduit therethrough to permit a borehole fluid and the cement to flow from the tubular to the annulus.

Embodiment 5

The system of any prior embodiment, wherein the component is a plug configured to be pumped through the tubular by borehole fluid, the plug creating a separation between the borehole fluid and the cement when the cement flows through the tubular.

Embodiment 6

The system of any prior embodiment, wherein the plug is a first pump down plug that is pumped ahead of the cement, the first pump down plug configured to receive a second pump down plug that separates the cement from borehole fluid and prevents backflow of the cement.

Embodiment 7

The system of any prior embodiment, wherein the first pump down plug and the second pump down plug are made from a drillable material.

Embodiment 8

The system of any prior embodiment, wherein the receptacle includes a deformable material lining a surface of the receptacle.

Embodiment 9

The system of any prior embodiment, wherein the deformable material includes a cement material.

Embodiment 10

The system of any prior embodiment, wherein the profile and the receptacle are formed from a single mass of the cement, the receptacle and the component combining to prevent the backflow without any moving parts.

Embodiment 11

A method of drilling and completing a length of a borehole, comprising: deploying a drilling assembly at an earth formation, the drilling assembly including a drill bit, a tubular connected to the drill bit, and a collar disposed between the tubular and the drill bit, the collar including a receptacle made from a drillable material, the receptacle having a profile that corresponds to a shape of a component to be deployed through the length of the tubular; drilling the length of the borehole by rotating the tubular and causing the drill bit to rotate; deploying the component through the tubular and seating the component in the receptacle, wherein seating results in a substantially fluid tight seal between the component and the drillable material; pumping a cement through the component, the collar and the drill bit and into an annulus between the tubular and a borehole wall, and preventing backflow of the cement; and allowing the cement to set and form a seal between the tubular and the borehole wall.

Embodiment 12

The method as in any prior embodiment, wherein the method includes a casing while drilling (CwD) operation, and the tubular is a length of a casing.

Embodiment 13

The method as in any prior embodiment, wherein the drill bit is made from a drillable material.

Embodiment 14

The method as in any prior embodiment, wherein the component and the receptacle form a conduit therethrough to permit a borehole fluid and the cement to flow from the tubular to the annulus.

Embodiment 15

The method as in any prior embodiment, wherein the component is a plug pumped through the tubular by borehole fluid, the plug creating a separation between the borehole fluid and the cement when the cement flows through the tubular.

Embodiment 16

The method as in any prior embodiment, wherein the plug is a first pump down plug that is pumped ahead of the cement, and deploying the component includes pumping the first pump down plug with a borehole fluid, pumping the cement after the first pump down plug, and thereafter deploying a second pump down plug that separates the cement from the borehole fluid.

Embodiment 17

The method as in any prior embodiment, wherein the first pump down plug and the second pump down plug are made from a drillable material.

Embodiment 18

The method as in any prior embodiment, wherein the receptacle includes a deformable material lining a surface of the receptacle.

Embodiment 19

The method as in any prior embodiment, wherein the deformable material includes a cement material.

Embodiment 20

The method as in any prior embodiment, wherein the profile and the receptacle are formed from a single mass of the cement, the receptacle and the component combining to prevent the backflow without any moving parts.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A system for performing a drilling and completion operation, comprising:

a drill bit;

a tubular connected to the drill bit and configured to be rotated to rotate the drill bit and drill a length of a borehole, the tubular configured to be left in the borehole and cemented in place after the length of the borehole is drilled, the tubular and the drill bit forming a conduit to permit cement to be pumped through the tubular and the drill bit and into an annulus between the tubular and a borehole wall; and a collar disposed between the tubular and the drill bit, the collar including a receptacle made from a first drillable material, the receptacle having a profile that corresponds to a shape of a component deployed through the length of the tubular, the receptacle configured to form a fluid tight seal between the component and the drillable material when the component is seated in the receptacle, wherein the collar and the component prevent backflow of the cement without any moving parts when the component is seated in the receptacle.

2. The system of claim 1, wherein the drilling and completion operation is a casing while drilling (CwD) operation, and the tubular is a length of a casing.

3. The system of claim 1, wherein the drill bit is made from a second drillable material.

4. The system of claim 1, wherein the component and the receptacle form a conduit therethrough to permit a borehole fluid and the cement to flow from the tubular to the annulus.

5. The system of claim 4, wherein the component is a plug configured to be pumped through the tubular by borehole fluid, the plug creating a separation between the borehole fluid and the cement when the cement flows through the tubular.

6. The system of claim 5, wherein the plug is a first pump down plug that is pumped ahead of the cement, the first pump down plug configured to receive a second pump down plug that separates the cement from borehole fluid and prevents backflow of the cement.

7. The system of claim 6, wherein the first pump down plug and the second pump down plug are made from a third drillable material.

8. The system of claim 1, wherein the receptacle includes a deformable material lining a surface of the receptacle.

9. The system of claim 8, wherein the deformable material includes a cement material.

10. The system of claim 9, wherein the profile and the receptacle are formed from a single mass of the cement.

11. A method of drilling and completing a length of a borehole, comprising:

deploying a drilling assembly at an earth formation, the drilling assembly including a drill bit, a tubular connected to the drill bit, and a collar disposed between the tubular and the drill bit, the collar including a receptacle made from a drillable material, the receptacle having a profile that corresponds to a shape of a component to be deployed through the length of the tubular;

drilling the length of the borehole by rotating the tubular and causing the drill bit to rotate;

deploying the component through the tubular and seating the component in the receptacle, wherein seating results in a fluid tight seal between the component and the drillable material;

pumping a cement through the component, the collar and the drill bit and into an annulus between the tubular and a borehole wall;

preventing backflow of the cement, wherein the collar and the component prevent backflow of the cement without any moving parts when the component is seated in the receptacle; and allowing the cement to set and form a seal between the tubular and the borehole wall.

12. The method of claim 11, wherein the method includes a casing while drilling (CwD) operation, and the tubular is a length of a casing.

13. The method of claim 11, wherein the drill bit is made from a drillable material.

14. The method of claim 11, wherein the component and the receptacle form a conduit therethrough to permit a borehole fluid and the cement to flow from the tubular to the annulus.

15. The method of claim 14, wherein the component is a plug pumped through the tubular by borehole fluid, the plug creating a separation between the borehole fluid and the cement when the cement flows through the tubular.

16. The method of claim 15, wherein the plug is a first pump down plug that is pumped ahead of the cement, and deploying the component includes pumping the first pump down plug with a borehole fluid, pumping the cement after the first pump down plug, and thereafter deploying a second pump down plug that separates the cement from the borehole fluid.

17. The method of claim 16, wherein the first pump down plug and the second pump down plug are made from a drillable material.

18. The method of claim 11, wherein the receptacle includes a deformable material lining a surface of the receptacle.

19. The method of claim 11, wherein the deformable material includes a cement material.

20. The method of claim 19, wherein the profile and the receptacle are formed from a single mass of the cement.

* * * * *